US005138956A

United States Patent [19]

Rushbrook et al.

[11] Patent Number: 5,138,956

[45] Date of Patent: Aug. 18, 1992

[54] SHELF ASSEMBLY

[76] Inventors: James S. Rushbrook, 453 Warminster Dr., Oakville, Ontario, Canada, L6L 4N4; Riadh A. Sabir, 76 Mayfair Crescent, Bramalea, Ontario, Canada, L6S 3N4

[21] Appl. No.: 647,191

[22] Filed: Jan. 28, 1991

Related U.S. Application Data

[63] Continuation of Ser. No. 379,208, Jul. 13, 1989, abandoned, which is a continuation of Ser. No. 186,161, Apr. 26, 1988, abandoned.

[51] Int. Cl.[5] ..... A47B 9/00

[52] U.S. Cl. ..... 108/107; 108/111

[58] Field of Search ..... 108/107, 111, 144, 108, 108/148; 211/187, 189, 208, 207, 175

[56] References Cited

U.S. PATENT DOCUMENTS

| | | | |
|---|---|---|---|
| 395,328 | 1/1989 | Jowell | 108/110 |
| 2,253,573 | 8/1941 | Nave | 108/110 X |
| 2,267,106 | 12/1941 | Jellies | 108/107 X |
| 2,301,507 | 11/1943 | Bitney | 108/110 |
| 2,346,430 | 4/1944 | Hanson | 108/110 X |
| 2,470,765 | 5/1949 | Dunston | 108/110 |
| 2,579,704 | 12/1951 | Saul, Jr. | 108/110 X |

FOREIGN PATENT DOCUMENTS

| | | | |
|---|---|---|---|
| 3329069 | 2/1985 | Fed. Rep. of Germany | 108/144 |
| 776290 | 1/1935 | France | 108/144 |
| 57241 | 6/1911 | Switzerland | 211/147 |

*Primary Examiner*—Jose V. Chen

*Attorney, Agent, or Firm*—Eugene J. A. Gierczak

[57] ABSTRACT

The combination of the shelf assembly and a locker having a spaced first and second vertical wall, including: a firsr pair of spaced supports releasably secured to the first vertical wall, a second pair of spaced vertical supports releasably secured to the second vertical wall, the first pair of spaced supports being longer than the second pair of spaced supports and extending vertically beyond the second pair of spaced supports; the first and second pair of supports presenting first and second sinusoidal support surfaces respectfully; and removal shelf members extending between the supports and solely supported by the first and said sinusoidal supports surfaces.

6 Claims, 1 Drawing Sheet

SHELF ASSEMBLY

This is a continuation of application Ser. No. 07/379,208 filed Jul. 13, 1989 now abandoned, which is a continuation of 07/186,161 filed Apr. 26, 1988, now abandoned.

FIELD OF INVENTION

This invention relates to an adjustable shelving assembly with supports.

BACKGROUND TO INVENTION

In order to take full advantage of the width of the locker and to retain a snug fit on the walls of the locker, this assembly was devised. It is difficult to insert shelves in the front of a locker because of the frontal vertical lip of a locker.

In order to overcome such difficulty, the combination of a shelf assembly and a locker having spaced first and second vertical walls is used, including: a first pair of spaced vertical support means and releaseable securement means to releasably secure said first pair of support means to said first vertical wall, a second pair of spaced vertical support means and releaseable securement means to releasably secure said second pair of support means to said second vertical wall, said first pair of spaced support means being longer than said second pair of spaced support means and extending vertically beyond said second pair of spaced support means; said first and second pair of support means presenting first and second sinusoidal support surfaces respectively, said first sinusoidal support surfaces adapted to face said second sinusoidal support surfaces between said first and second vertical walls; and removable shelf members extending between said support means and solely supported by said first and second sinusoidal support surfaces whereby said shelf members are insertable and removeable between said first and second sinusoidal support surfaces by engaging said first sinusoidal support surface for pivotable movement of said shelf member about said first sinusoidal support surface to engage and disengage respectively said second sinusoidal support surface.

Further, a shelf assembly for a locker is used having first and second fixedly spaced vertical walls connected to a back wall, said shelf assembly including: a first and second pair of spaced support members, said first pair of support members longer than the second pair of support members; said first pair of spaced support members including first flat sides and a first sinusoidal support surfaces opposite said first flat sides; said second pair of spaced support members including second flat sides and a second sinusoidal support surfaces opposite said second flat surfaces; releaseable securement means disposed between said first and second flat sides and said first and second vertical walls respectively to releaseably secure said first and second support member to said first and second vertical wall of said locker respectively; said first pair of spaced support members extending vertically beyond said second spaced pair of support members; removeable shelf members solely supported by said first and second sinusoidal support surfaces whereby said shelf members are insertable and removeable between said first and second sinusoidal support surfaces by engaging said first sinusoidal surface for pivotable movement of said shelf member about said first sinusoidal support surface to engage and disengage respectively said second sinusoidal support surface; flat cantilevered shelf members extending between said first pair of support members and fastened solely to said first pair of support members in the region beyond said second pair of spaced support means, said cantilevered shelf members supported at an upward acute angle with respect to said first pair of support means.

DISCLOSURE OF INVENTION

Figure 1:
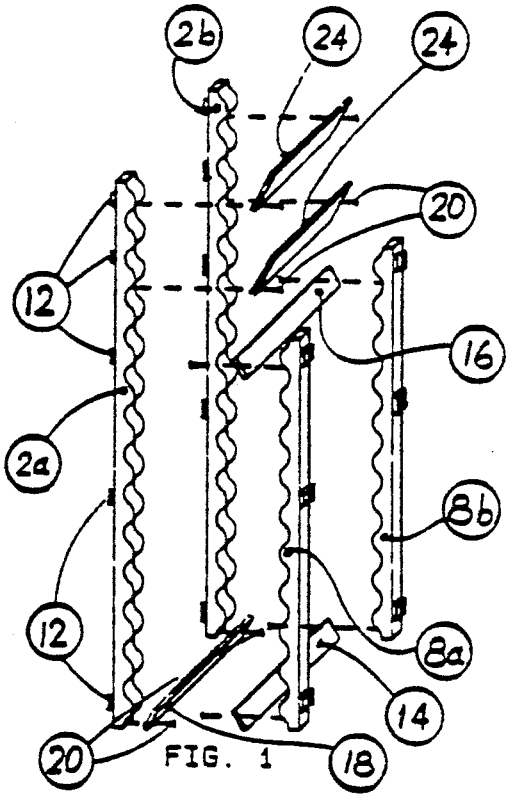
FIG. 1 is an exploded perspective view of the shelf assembly.
Figure 4:
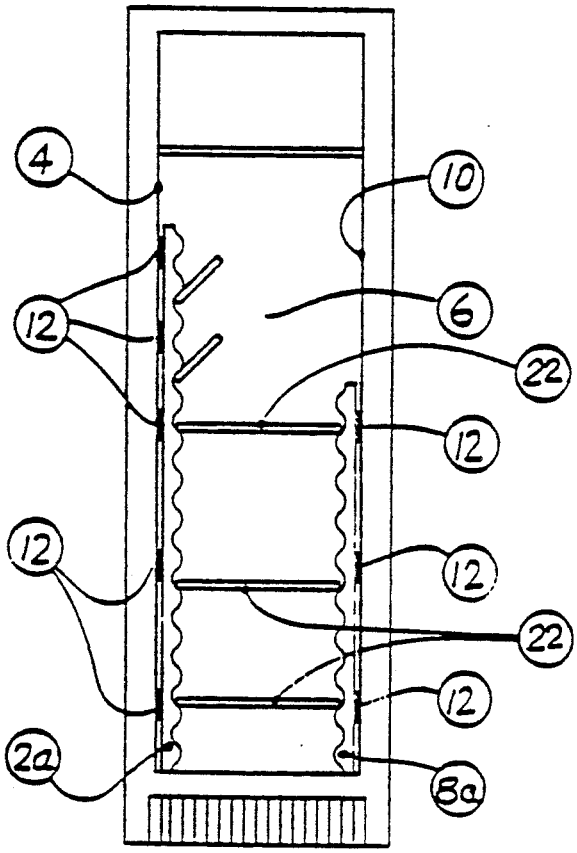
FIG. 4 is a front elevational view of the shelf assembly in a locker with the exterior horizontal and vertical lips removed.

The assembly is generally shown in FIG. 1 and includes a first pair of uprights or support members 2*a*, 2*b*, which is adapted to be fastened to one vertical wall 4 of a locker 6. A second pair of upright or support members, 8*a* and 8*b*, is adapted to be fastened to the opposite vertical wall 10 of locker 6. The uprights or support members 2*a*, 2*b*, 8*a*, and 8*b* are fastened to their vertical walls of locker 6 by double adhesive tape 12, as shown in FIG. 4.

The support members 2*a*, 2*b*, 8*a* and 8*b*, are board-like and include 3 flat sides and one side which is sinusoidal, as best illustrated in FIG. 1.

FIG. 1 shows the utilization of braces 14 and 16 which are adapted to connect support members 8*a* and 8*b*, so as to rigidify the assembly. Furthermore, brace 18 connects support members 2*a* and 2*b* so as to rigidify the assembly. Braces 14, 16 and 18 are connected to the support members by means of screws 20.

Figure 2:
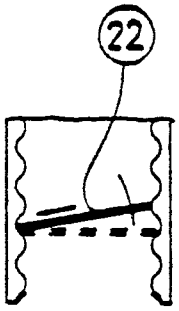
FIG. 2 is a partially front elevational view showing the insertion of a horizontal shelf.

The horizontal shelves 22 are supported by the sinusoidal portions of support members 2*a*, 2*b*, 8*a* and 8*b*. Auxilliary shelves 24 (top shelves) are anchored in place by metal screws 20 to the first pair support members 2*a* and 2*b*; the horizontal shelves 22 are positioned and adjusted by a pivoting action as shown in FIG. 2.

Horizontal shelf 22 may be adjusted upwardly or downwardly by selecting the sinusoidal portions of the support members 2*a*, 2*b*, 8*a* and 8*b*.

Figure 3:
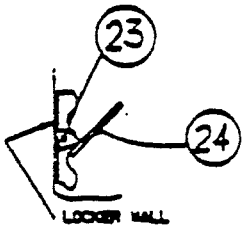
FIG. 3 is a partial front elevational view showing a shelf disposed at an acute angle.

Auxilliary shelves 24 may be used to retain small items such as wallets or watches. In order to prevent such items from falling in between the locker wall 4, auxilliary shelf 24 and support members 2*a* and 2*b*; a piece of quarter round 23 or other suitable filler may be used as best shown in FIG. 3.

The embodiments of the invention in which an exclusive property or privilege is claimed are defined as follows:

1. The combination of a shelf assembly and a locker having spaced first and second vertical walls, including: a first pair of spaced vertical support means and releaseable securement means to releasably secure said first pair of support means to said first vertical wall, a second pair of spaced vertical support means and releaseable securement means to releasably secure said second pair of support means to said second vertical wall, said first pair of spaced support means being longer than said second pair of spaced support means and extending vertically beyond said second pair of spaced support means; said first and second pair of support means presenting first and second sinusoidal support surfaces respectively, said first sinusoidal support surfaces adapted to face said second sinusoidal support surfaces between said first and second vertical walls; and removable shelf members extending between said support means and solely supported by said first and second sinusoidal support surfaces whereby said shelf members are insertable and removeable between said first and second sinusoidal support surfaces by engaging said first sinusoidal support surface for pivotable movement of said shelf member about said first sinusoidal support surface to engage and disengage respectively said second sinusoidal support surface; including flat cantilevered shelf members extending between said first pair of support means to said first pair of support means in the region beyond said second pair of spaced support means, said shelf members fastened to said first pair of spaced support means, and disposed at an upward acute angle with respect to said first pair of support means.

2. The combination as claimed in claim 1 including means for fastening said support means to said spaced vertical walls.

3. The combination as claimed in claim 2 including shelf members disposed horizontally and resting on said first and second part of sinusoidal support surfaces.

4. The combination as claimed in claim 3 wherein said spaced vertical walls comprise the opposite vertical walls of a locker.

5. A shelf assembly for a locker having first and second fixedly spaced vertical walls connected to a back wall, said shelf assembly including:

(a) a first and second pair of spaced support members, said first pair of support members longer than the second pair of support members;

(b) said first pair of spaced support members including first flat sides and a first sinusoidal support surfaces opposite said first flat sides;

(c) said second pair of spaced support members including second flat sides and a second sinusoidal support surfaces opposite said second flat surfaces;

(d) releaseable securement means disposed between said first and second flat sides and said first and second vertical walls respectively to releaseably secure said first and second support member to said first and second vertical wall of said locker respectively;

(e) said first pair of spaced support members extending vertically beyond said second spaced pair of support members;

(f) removeable shelf members solely supported by said first and second sinusoidal support surfaces whereby said shelf members are insertable and removable between said first and second sinusoidal support surfaces by engaging said first sinusoidal surface for pivotable movement of said shelf member about said first sinusoidal support surface to engage and disengage respectively said second sinusoidal support surface;

(g) flat cantilevered shelf members extending between said first pair of support members and fastened solely to said first pair of support members in the region beyond said second pair of spaced support means, said cantilevered shelf members supported at an upward acute angle with respect to said first pair of support means.

6. The combination as claimed in claim 1 wherein said releaseable securement means comprises double sided adhesive tape.

* * * * *